US005143425A

United States Patent [19]

Boucherie

[11] Patent Number: 5,143,425

[45] Date of Patent: Sep. 1, 1992

[54] DEVICE FOR CUTTING BRISTLES OF TOOTH BRUSHES TO DIFFERENT LENGTHS IN DIFFERENT SELECTED AREAS OF A TUFT PATTERN

[75] Inventor: Lionel P. Boucherie, Izegem, Belgium

[73] Assignee: G. B. Boucherie N.V., Izegem, Belgium

[21] Appl. No.: 704,021

[22] Filed: May 22, 1991

[30] Foreign Application Priority Data

May 31, 1990 [EP] European Pat. Off. ..... 90110324

[51] Int. Cl.[5] ..... A46D 9/02; A46D 1/06; A46D 3/08

[52] U.S. Cl. ..... 300/2; 340/21

[58] Field of Search ..... 300/2, 21; 83/14

[56] References Cited

U.S. PATENT DOCUMENTS 764,898 7/1904 Mumford ..... 300/2
4,869,277 9/1989 Olsen ..... 300/21

FOREIGN PATENT DOCUMENTS 78569 5/1983 European Pat. Off. ..... 300/2
1532773 1/1971 Fed. Rep. of Germany .
2528677 12/1983 France .

*Primary Examiner*—Douglas D. Watts
*Attorney, Agent, or Firm*—Sixbey, Friedman, Leedom & Ferguson

[57] ABSTRACT

A device for cutting bristles of tooth brushes to different lengths in different selected areas of a tuft pattern comprises a support for holding the brush head, at least one shield associated with a selected area of the tuft pattern and movable between a rest position distant from the head and the bristle tips and an active position close to the head; the shield is provided with ramp means for engaging the tips of the bristles in the selected area and for imparting a radial component of movement to the engaged bristle tips to bend the corresponding bristles in directions away from the bristles outside the selected area upon movement of said shield from its rest position to its active position.

20 Claims, 4 Drawing Sheets

Figure 1:
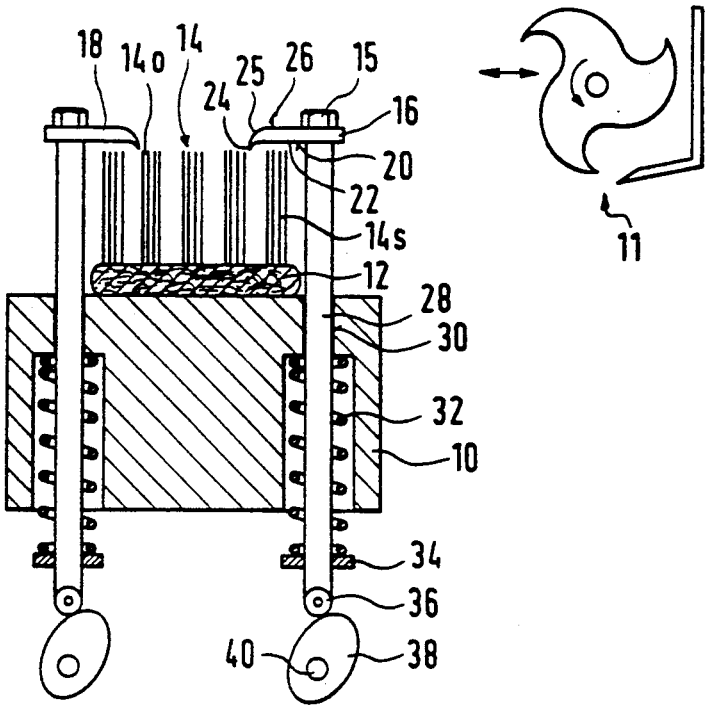

DEVICE FOR CUTTING BRISTLES OF TOOTH BRUSHES TO DIFFERENT LENGTHS IN DIFFERENT SELECTED AREAS OF A TUFT PATTERN

The present invention relates to a device for cutting bristles of tooth brushes to different lengths in different selected areas of a tuft pattern.

It has now become customary to manufacture brushes having tufts of bristles protruding from the brush head at different lengths, usually two different "short" and "long" lengths.

DE-A-34 15 870 and EP-A-0 078 569 disclose devices having elongated deflection members which are moved linearly across the head in a direction transverse to the bristles, the deflection members having curved underside surfaces for bending selected rows of tufts of bristles towards the head, while leaving other rows of tufts unaffected.

The unaffected rows of tufts can then be machine-cut at a first "short" length, and after removal of the deflection members, the selected rows of tufts resume their upright position and can be machine-cut at a second "long" length.

Although these devices operate satisfactorily, they are usable limitatively when it is desired to separate in the brush parallel rows of "long" and "short" tufts of bristles, but not when it is desired to separate non-parallel areas of selected shapes for the "long" and the "short" tufts.

DE-B-1 532 773 discloses a device provided with a flat plate-like shield member or template having a shape which corresponds to a selected area of the brush and the shield member being movable substantially in a direction parallel to the tufts from a rest position distant from the head and the bristle tips to an active position close to the head, whereby the shield member engages and bends the bristles in the selected area of the brush while leaving unaffected the bristles outside this area.

It is, however, clear that this rudimentary arrangement does not allow to accurately obtain finely delimited patterns of "long" and "short" bristles, since the bristles lying close the out-line of the shield member can be engaged or not depending on various factors, like for instance manufacturing and positioning tolerances. Further, since the flat underside surface of the shield member engages the tips of the bristles substantially perpendicularly, the latter are bent in uncontrollable directions; some of them can therefore hit other bristles outside the selected area and deflect them more or less, and such deflected bristles are cut at inaccurate lengths.

It is, therefore, an object of the invention to provide a device for cutting bristles of tooth brushes to different lengths in different selected areas of a tuft pattern which is effective to separate accurately those tuft bristles in the selected area from other tuft bristles outside the selected area.

It is a further object of the invention to provide a device which allows to separate in the brush finely delimited selected areas of tuft bristles of virtually any desired patterns Another object of the invention is to design the device in such a manner as to permit easy and fast modification from one pattern of selected areas to another one.

According to the invention the device comprises a support for holding a brush head having tufts of bristles projecting therefrom, at least one shield member associated with a selected area of the tuft pattern and movable with respect to the support at least in a direction parallel to the bristles between a rest position distant from the head and the bristle tips and an active position close to the head, a cutter for cutting the exposed ends of the bristles outside the selected area, and a ramp means on the shield member for engaging the tips of the bristles in the selected area of the tuft pattern. The shield member, when moving from its rest position to its active position, engaging and bending the bristles in the selected area while leaving unaffected the bristles outside the selected area. The ramp means imparts a radial component of movement to the engaged bristle tips to bend the corresponding bristles in directions away from the bristles outside the selected area upon movement of the shield member from its rest position to its active position.

In an advantageous embodiment of the invention, the ramp means is a sloping surface between a substantially flat bottom surface of the shield member and a projecting rib bordering the bottom surface and corresponding to a line of separation of the selected area from other areas of the tuft pattern.

In a further advantageous embodiment the shield member is strip-shaped and provided with sloping surface as ramp means between a lengthwise extending groove and two lateral parallel projecting ribs, wherein the shield member is rotatable about an axis perpendicular to the bristles and lying outside the brush head at a level comprised within the height of the bristles. For cutting the bristle, the shield member is pivoted over predetermined bristles, which are not to be cut, and deflects them laterally.

Figure 2:
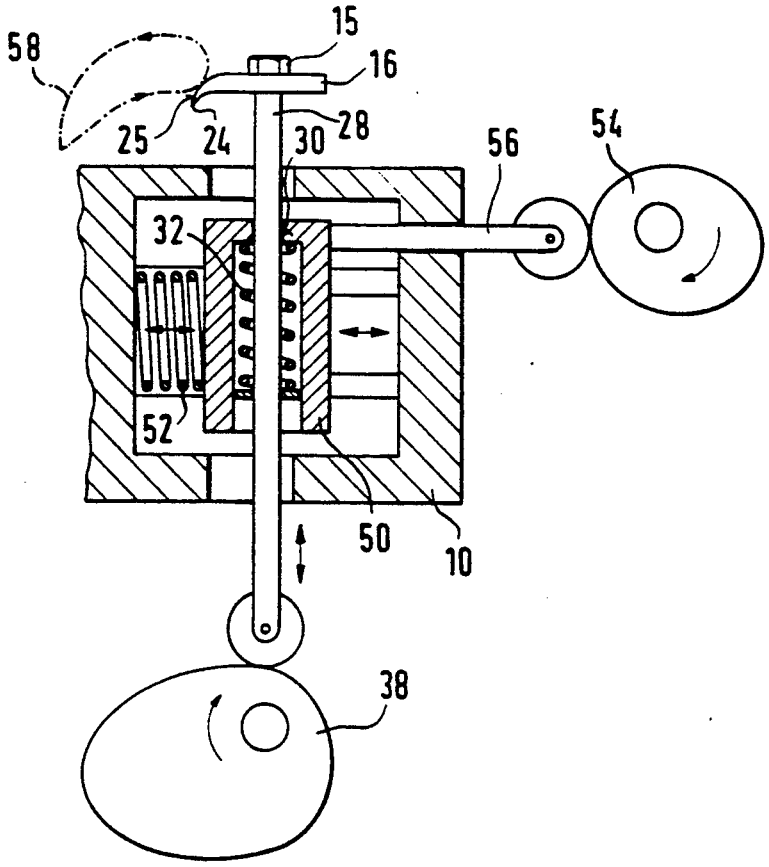
Figure 5:
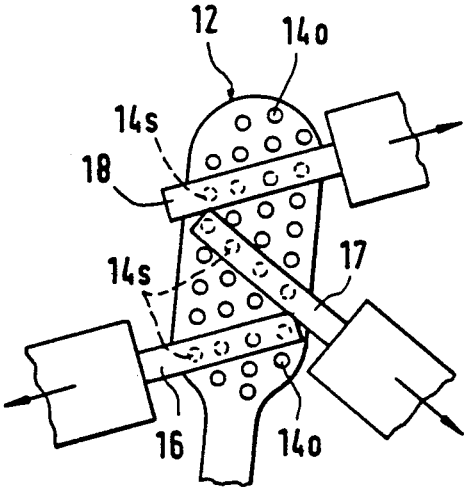
Figure 6:
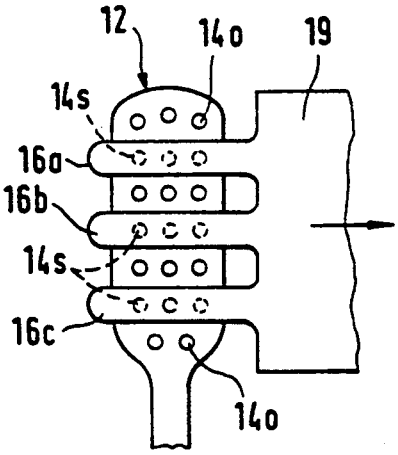
Figure 7:
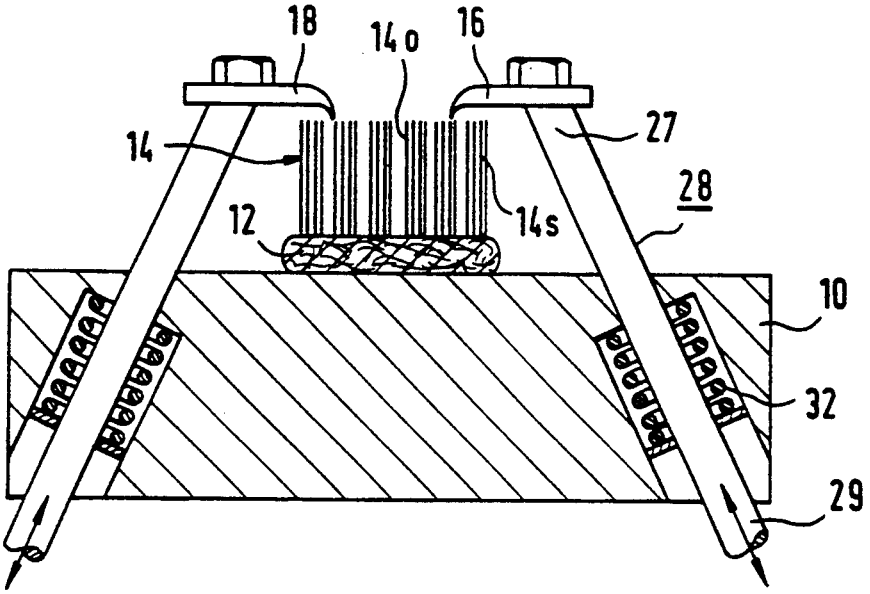
Figure 8:
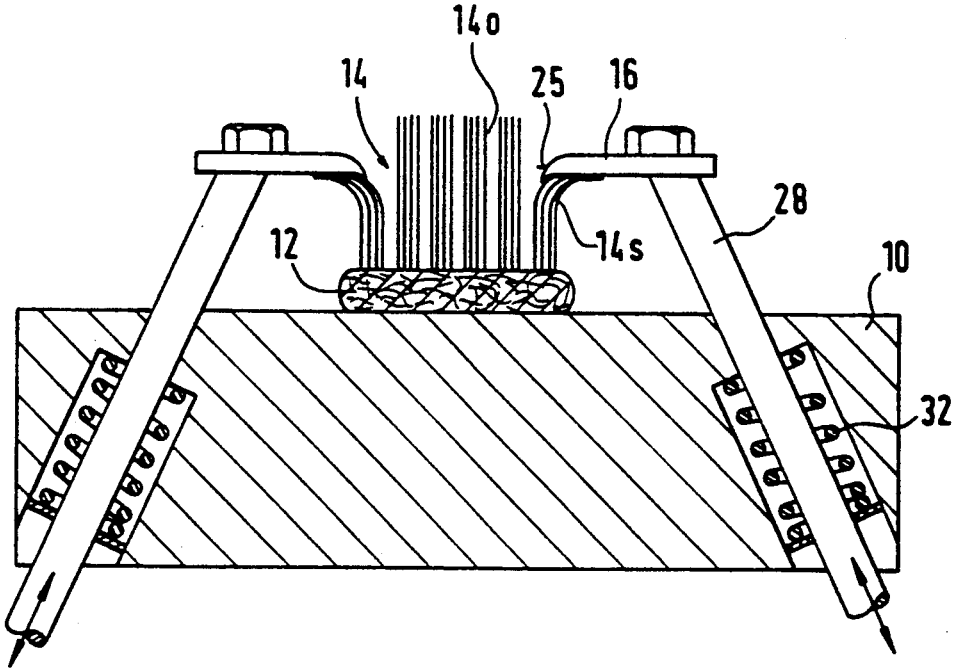
Figure 9:
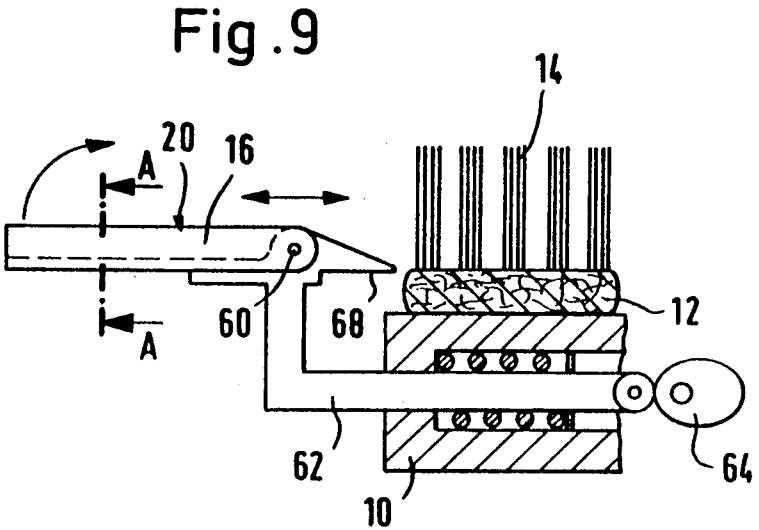
Figure 11:
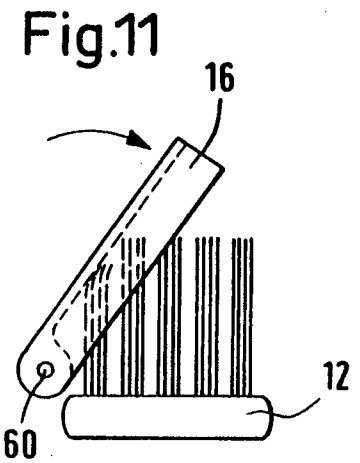
Figure 12:
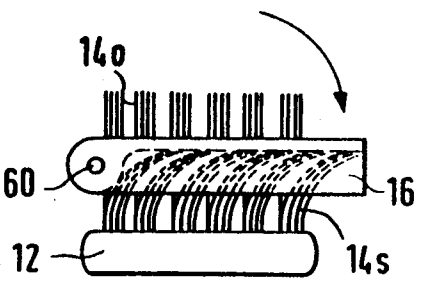
Figure 13:
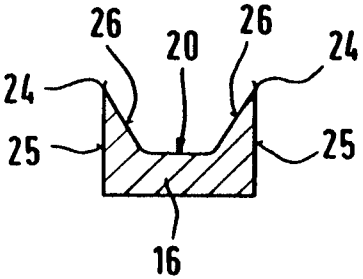
Figure 10:
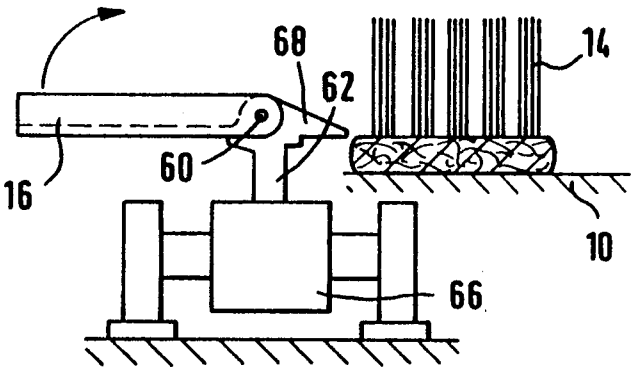

These and other details and advantages of the invention will now be described with reference to the appended drawings in which:

FIG. 1 is a schematic cross section of a first embodiment of the device according to the invention, FIG. 2 is a schematic cross section of a detail illustrating an alternative embodiment of the invention, FIGS. 3 to 6 are schematic top views of different brush heads illustrating various further embodiments of the invention, FIGS. 7 and 8 are schematic cross sections of a further embodiment of the invention shown in two different positions, FIG. 9 is a schematic cross section of another embodiment of the invention, FIG. 10 is a schematic cross section of a variant of the embodiment of FIG. 9, FIGS. 11 and 12 are schematic cross sections illustrating the operation of the embodiment of FIG. 9 and the variant of FIG. 10, and FIG. 13 is a detailed cross sectional view taken along line A-A at FIG. 9.

In the cross sectional view of the device illustrated schematically in FIG. 1, 10 denotes a support for holding the head 12 of a brush, the brush extending substantially along a line normal to the Figure.

The support 10 is provided with any suitable conventional means for temporarily holding the brush in a predetermined position on the support. Such means are well-known in the art and they are not represented for the sake of clarity.

The brush head 12 has bristles 14 arranged in tufts and extending therefrom vertically upwardly when considering the Figure, it being understood that since the head extends in both directions, there are such tufts of bristles over a certain distance from before to beyond the plane of the Figure.

The device comprises plate-like shield members 16, 18 extending generally in parallel to the head, i.e.: also in perpendicular to the bristles 14. Since the structure and operation of both shield members are substantially identical, the ensuing description is directed solely to shield member 16.

As seen in cross section, shield member 16 has an underside surface 20 facing the head 12 which is recessed to exhibit a substantially flat bottom 22 over a portion of its underside 20 and is bordered by a projecting rib 24 extending along the edge 25 of the shield member 16.

A connecting sloping surface 26 is provided between the flat bottom surface 22 and the projecting rib 24 of the underside of the shield member !6 for purposes to be explained later.

The shield member 16 is displaceably mounted with respect to the support 10 by means of a carrier rod 28 extending in this embodiment substantially in parallel to the hairs and guided in a through-bore 30 of the support 10.

The rod is biased downwardly by any suitable return means 32, for example a return spring trapped between the support and a washer 34 fastened to the rod 28. At its lower end, the rod carrie a roller 36 rotatable about a horizontal axis and co-operating with an eccentric cam member 38 locked to a control shaft 40 and rotatable therewith.

According to the rotation angle of the control shaft 40, the cam member 38 and the return means 32 cooperate in reciprocating the carrier rod 28 and the shield member 16 between an upper rest position, in which the shield member is distant from the head 12 and from the bristles 14, and a lower active position closer to the head 12, in which the underside 20 of the shield member 16 engages and bends those bristles 14*s* which are comprised in a selected area of the brush head bordered by the projecting rib 24 of the shield member 16.

During the downward stroke of the shield member 16, its underside surfaces 22, 26 form ramp means for engaging the tips of the bristles in the selected area of the tuft pattern and for imparting a radial component of movement to the engaged bristle tips to bend the corresponding bristles. More specifically, the sloping surfaces 26 adjacent the projecting rib 24 cause the bristles 14*s* to bend in directions away from the edge 25 of the shield member, thereby preventing these bristles 14*s* from bending in uncontrolled directions, notably towards the bristles 14*o* lying outside the selected area.

Accordingly, the line of separation of the selected area from other areas of the tuft pattern can be very finely delimited and can be given virtually any design as desired.

As well-known, once the shield members 16, 18 have been lowered, they maintain the bristles 14*s* in the selected area in such a bent condition that the free ends of the bristles 14*s* are kept at a vertical distance from the head 12 lower than the length of the other bristles 14*o* lying outside of the selected area.

These other—unaffected—bristles 14*o*are then machine-cut at a first "short" distance from the head 12. As well known in the art, this is achieved by means of a schematically shown cutter 11 which cuts the exposed ends of the bristles.

Thereafter, the shield members 16, 18 are returned by their respective cam members 38 to the upper rest position and the bristles 14*s* in the selected area are released and resume their upright position. Whenever necessary, should it happen that these bristles or some of them retain temporarily a bent shape, they can be urged to their upright position by means of a comb arrangement, also well-known and not illustrated in the drawings.

At this stage, the bristles 14*s* in the selected area protrude from the head 12 at a higher distance that the other bristles 14*o* and they are machine-cut at a second "long" distance from the head 12.

This cutting of the "long" bristles can be effected at the same stage, i.e.: while the brush 12 is held on the same support 10, which implies that the shield members 16, 18 must be shifted aside in order to clear the access to the bristles. Numerous means convenient for this purpose are to be found in the art and they need not be illustrated nor described.

Alternatively, the cutting of the "long" bristles can be effected at a different stage of the machine In the alternative embodiment partially illustrated in FIG. 2, the carrier rod 28 of the shield member 16 is further mounted for horizontal movement, i.e.: in perpendicular to the bristles 14, in addition to its mounting for vertical movement as in the first embodiment.

The carrier rod 28 extends in a through-hole 30 of a carrier block 50 mounted on the support 10 and displaceable sidewise with respect to the latter by any suitable means, for example a second return spring 52 trapped between the support 10 and the carrier block 50 and cooperating with a second cam member 4 acting upon a stem 56 fixed laterally to the carrier block 50. The two cam members 38, 54 are shaped and synchronized in such a manner as to define a combination of vertical and horizontal displacements for the shield member along a closed-loop path 58 shown in dashed lines at FIG. 2.

Starting from the position illustrated, and assuming that both cam members rotate clockwise, the shield member 16 is first moved substantially upwards to its uppermost position, then sidewise toward the head 12 and progressively downwards until it reaches its lowermost and innermost position, thereafter, the shield 16 is moved progressively sidewise away from the head 12 and upwards until is resumes its start position illustrated.

The purpose of such an arrangement is three-fold:

firstly, the horizontal movement of the shield 16 allows to shift it sidewise away from the brush head 12 in order to clear access for any desired treatment, secondly, the curve of the descending stroke of the shield member can be adapted to the bending shape of the bristles 14*s* therebelow, and thirdly, the slight horizontal movement of the shield member during its downward stroke causes its edge 25 to slightly engage laterally the adjacent bristles 14*o* outside the selected area for straightening and maintaining the same into a correct vertical position.

FIGS. 3 to 6 are schematic top views of further embodiments showing non-limitative examples of patterns of bristle separation which can be obtained with the use of the device of the invention.

Figure 3:
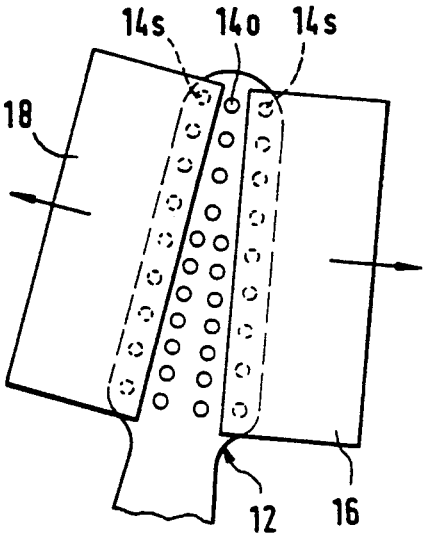

FIG. 3 shows a brush head 12 in schematic top view, in which two non-parallel side rows of tufts of bristles 14*s* are separated from unaffected bristles 14*o* by means of two substantially rectangular-shaped shield members 16, 18.

Figure 4:
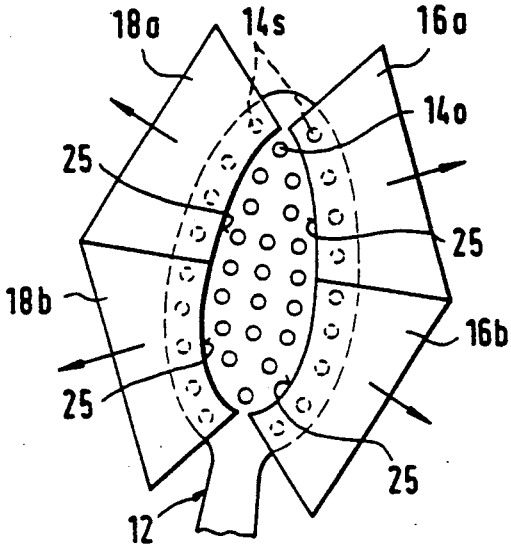

FIG. 4 illustrates a brush head 12 in which two side curved rows of tufts of bristles 14*s* are separated by means of four substantially trapezoidal-shaped adjacent shield members 16*a*, 16*b*, 18*a*, 18*b* having slightly concavely curved inner edges 25. The number of shield members can be more than two on each side in accordance with the curvature of the side rows.

FIG. 5 illustrates a brush head in which three straight rows of tufts of bristles 14*s* successively arranged in zigzag fashion along different diagonal rows with respect to the longitudinal axis of the head 12 are separated by means of three strip-shaped shield members 16, 17, 18 having a width limited to the width of a single row of tufts.

FIG. 6 illustrates a brush head 12 in which three transverse parallel rows of tufts of bristles 14*s* are separated by three strip-shaped shield members 16*a*, 16*b*, 16*c* borne by a common holding member 19.

Numerous modifications and variations will become readily apparent to a man skilled in the art, it being understood that the number of shield members, from only one to a plurality, will depend upon the complexity of the pattern of the selected area.

In the further embodiment of the invention illustrated in FIGS. 7 and 8, the carrier rods 28 of the shield members 16, 18 are inclined with respect to the support !0 and with respect to the bristles 14, their upper ends 27 being closer to the brush head 12 than their lower ends 29.

Therefore, the downward movement of the shield member 16, as illustrated in FIG. 8, also results in a sidewise movement away from the brush head 12. The edges 25 of the shield members are then laterally distant from the adjacent bristles 14*o* lying outside the selected areas.

In the embodiments of FIGS. 9 to 13, the shield member 16 is rotatable about a horizontal axis 60 lying outside the brush head 12 and at a level comprised within the height of the bristles 14. The shield member 16 is for example a strip-shaped member suitable for obtaining a pattern as illustrated in FIGS. 5 or 6. As shown in the detailed cross section of FIG. 13, its underside is provided with a lenghtwise extending groove defining a recessed bottom 22 connected by two sloping surfaces 26 to two parallel projecting ribs 24.

The shield member 16 is carried by a carrier slide 62 movable horizontally with respect to the support 10. Suitable drive means are provided for reciprocating the carrier slide 62 with respect to the support 10 and for pivoting the shield member 16 with respect to the carrier slide 62.

In the embodiment of FIG. 9, the carrier slide 62 is driven by a cam arrangement 64 similar to the cam arrangements described heretofore.

In the alternative embodiment of FIG. 10, the carrier slide 62 is driven by a specific actuator 66.

These embodiments operate as follows:

In the rest position illustrated at FIGS. 9 or !0, the shield member 16 extends horizontally away from the bristles !4 of the brush 12 with its underside 20 facing upwards.

The shield member 16 is then pivoted upwardly, or clockwise when considering the Figures, until its underside 20 engages laterally the bristles 14*s* on the side of the brush 12.

Upon continued pivoting of the shield member 16, the sloping surfaces 26 of its underside 20 and its bottom surface 22 act as ramp means for engaging and for bending successively all the bristles 14*s* comprised in a row perpendicular to the axis of rotation 60 of the shield member 16.

In the final position illustrated in FIG. 12, the shield member 16 extends horizontally over the brush head 12 and maintains the bristles 14*s* in the selected area in a bent condition, which permits to carry out the cutting of the other bristles 14*o* lying outside the selected area as already mentioned.

The bristles 14*s* below the shield member are subsequently released by reverse pivoting of the shield member 16 back to its rest position away from the head 12 and from the bristles 14*s*.

Advantageously, the carrier slide 62 is provided with a laterally extending finger 68 engageable with the head !2 of the brush itself with a view to holding the latter firmly against the support 10.

The driving of all movable members described hereinabove can be achieved by any known actuators: mechanical, electromagnetic, pneumatic, hydraulic, nonlimitatively, and/or any combination thereof.

It is finally noted that most of the embodiments and their variants can be easily and quickly modified from one pattern to another one. Since the shield members 16 are fastened to their carrier rods 28 by releasable means, e.g.: a screw 15, they can be replaced by other shield members having different outlines for defining with selected areas of tufts of bristles of different patterns.

What is claimed is:

1. A device for cutting bristles of tooth brushes to different lengths in different selected areas of a tuft pattern comprising:

a support for holding a brush head having tufts of bristles projecting therefrom, at least one shield member associated with a selected area of the tuft pattern and movable with respect to said support at least in a direction parallel to the bristles between a rest position distant from the brush head and the bristle tips and an active position close to the brush head, said shield member, when moving from its rest position to its active position, engaging and bending the bristles in the selected area while leaving unaffected the bristles outside the selected area;

a cutter for cutting the exposed ends of the bristles outside the selected area; and ramp means provided on said shield member for engaging the tips of the bristles in the selected area of the tuft pattern and for imparting a radial component of movement to the engaged bristle tips to bend the corresponding bristles in directions away from the bristles outside the selected area upon movement of said shield member from its rest position to its active position

2. The device of claim 1, wherein said shield member is a substantially plate-shaped member having a recessed underside face facing the support and bordered by a projecting rib corresponding to a line of separation of said selected area from other areas of said tuft pattern.

3. The device of claim 2, wherein said recessed underside face has a substantially flat bottom surface over a portion of its surface and connection sloping surfaces between said bottom surface and said projecting rib.

4. The device of claim 1 comprising a carrier member movably mounted with respect to said support, and wherein said shield member is releasably mounted onto said carrier member.

5. The device of claim 4, wherein said carrier member is a carrier rod and actuating means are provided for reciprocally driving said carrier rod.

6. The device of claim 5, wherein said carrier rod extends substantially in parallel to the bristles of the brush.

7. The device of claim 6, wherein said carrier rod is movable both in parallel and in perpendicular direction with respect to the bristles.

8. The device of claim 7 comprising respective actuators for driving said carrier rod in parallel and in perpendicular directions with respect to the bristles, and wherein said actuators are synchronized in a manner to define a closed-loop path for the shield member.

9. The device of claim 5, wherein said carrier rod is inclined with respect to the bristles .

10. The device of claim wherein said shield member is a strip-shaped member having a width limited to the width of a single row of bristle tufts.

11. The device of claim 10 comprising at least two strip-shaped shield members arranged along different diagonal rows of bristle tufts.

12. The device of claim 10 comprising at least two parallel strip-shaped shield members arranged along transverse rows of bristle tufts and a common holding member bearing said strip-shaped shield members.

13. The device of claim 1 comprising at least two substantially rectangular shield members corresponding to non-parallel side rows of tufts of bristles.

14. The device of claim 1 comprising at least two adjacent shield members on either side of the brush head and corresponding to curved rows of tufts of bristles.

15. The device of claim 14, wherein said shield members are substantially trapezoidally shaped and have concavely curved inner edges.

16. A device for cutting bristles of tooth brushes to different lengths in different selected areas of a tuft pattern comprising:

a support for holding a brush head having tufts of bristles projecting therefrom;

at least one shield member associated with a selected area of the tuft pattern and movable with respect to said support at least in a direction parallel to the bristles between a rest position distant from the brush head and the bristle tips and an active position close to the brush head, said shield member, when moving from its rest position to its active position, engaging and bending the bristles in the selected area while leaving unaffected the bristles outside the selected area; and a cutter for cutting the exposed ends of the bristles outside the selected area;

wherein said shield member is rotatable about an axis perpendicular to the bristles, said axis lying outside the brush head at a level comprised within the height of the bristles, and that said shield member is a strip-shaped member provided with a length-wise extending groove, sloping surfaces and two parallel projecting ribs, said groove defining a recessed bottom connected by said sloping surfaces to said ribs to form a ramp means for engaging the tips of the bristles in the selected area of the tuft pattern and for imparting a radial component of movement to the engaged bristle tips to bend the corresponding bristles away from the bristles outside the selected area upon movement of said shield member from its rest position to its active position.

17. The device of claim 16, wherein said shield member is carried by a carrier slide movable in perpendicular with respect to the bristles.

18. The device of claim 16, wherein said shield member is a strip-shaped member having a width limited to the width of a single row of bristle tufts.

19. The device of claim 18 comprising at least two strip-shaped shield members arranged along different diagonal rows of bristle tufts.

20. The device of claim 18 comprising at least two parallel strip-shaped shield members arranged along transverse rows of bristle tufts and a common holding member bearing said strip-shaped shield members.

* * * * *